United States Patent [19]

Rooney et al.

[11] Patent Number: 4,654,620

[45] Date of Patent: Mar. 31, 1987

[54] ASYMMETRICAL FUSE LINKS

[75] Inventors: William J. Rooney, Clifton; Francis J. Rooney, Ramsey, both of N.J.

[73] Assignee: Commercial Enclosed Fuse Co. of New Jersey, North Bergen, N.J.

[21] Appl. No.: 839,514

[22] Filed: Mar. 14, 1986

[51] Int. Cl.[4] ..... H01H 85/04

[52] U.S. Cl. ..... 337/296; 337/159; 337/295

[58] Field of Search ..... 337/159, 160, 295, 296, 337/290

[56] References Cited

FOREIGN PATENT DOCUMENTS 921200 3/1963 United Kingdom ..... 337/295

*Primary Examiner*—Harold Broome

*Attorney, Agent, or Firm*—Arthur L. Plevy

[57] ABSTRACT

An asymmetrical fuse link employs a planar conductive member with the top and bottom surfaces manifested by having a series of alternating partial apertures with the alternating apertures in the top surface being of a first larger area followed by a second smaller area followed by a next larger area and so on. The bottom surface of the link also having a plurality of alternating partial apertures with the smaller diameter aperture of the bottom surface aligned with a larger diameter aperture in the top surface and so on. Thus the top and bottom surfaces each have partial apertures, with one of which is of a larger area and the next of a smaller area and arranged along a common axis and separated by a central aperture. Based on the above construction of the link, an arc generated during current interruption of the fuse is caused to zig zag along opposite edges of the planar member from a first to a second end. The configuration allows one to employ less material in implementing a fuse link than employed with prior art configurations, and makes for an excellent very fast acting current limiting fuse without a high peak recovery voltage.

12 Claims, 2 Drawing Figures

ASYMMETRICAL FUSE LINKS

BACKGROUND OF THE INVENTION

This invention relates in general to electrical fuses and more particularly to an electric fuse which contains an asymmetrical link to provide superior operating characteristics.

It is well known to those skilled in the art that fusible links which are commonly used in fuses are employed in a great number of applications.

Essentially, a fusible link may consist of a ribbon of relatively thin metal commonly copper or silver which is disposed singly or in multiples between two end terminals or between two end caps. The link will melt when an excess of current based on the rating of the link is passed through the link and hence such links afford circuit protection. The state of the fuse art is such that the prior art is replete with many patents and articles depicting fuses of different types wich are employed for different circuit operation and different circuit conditions. A major objective in the design of many fuses is for a fast reaction time which means that the fuses should respond very rapidly to a current which exceeds the rating of the fuse. In this manner, the fuse will properly protect the associated circuit.

Another problem which as been faced by fuse designers is the suppression of high·peak recovery voltages. As one knows, a fuse may be protecting an inductive circuit, and hence when current is interrupted in such a circuit, a large voltage transient is produced where the magnitude is proportional to the inductance as multiplied by the rate of change of current with respect to time. This is a common problem in current limiting fuses.

Such peak voltages can be of the order of magnitude of thousands of volts. Hence fuse devices which operate in such environments require arc quenching means to suppress such arcs in order to further prevent these large voltages from affecting the circuit or preventing proper fuse operation. Therefore, as one can ascertain, the problem of arc suppression is incompatible with the problem of reaction time. As one can see, the shorter the reaction time, the higher the arc voltage provided in an inductive circuit. Hence fuse designers have been cognizant of these factors and have proposed various designs to accommodate both requirements.

It is, therefore, an object of the present invention to provide a fuse link construction which is capable of reacting in a relatively rapid manner to an overload condition and to give superior speed and current limiting capability while further suppressing the attendant peak recovery voltage produced during fuse operation.

BRIEF DESCRIPTION OF THE PREFERRED EMBODIMENT

An asymmetrical fuse link apparatus for deployment between first and second end terminals of an electrical fuse, comprises a planar member having top and bottom relatively parallel surfaces, with said top surface containing a first plurality of alternating partial apertures with a first aperture being of a larger area than a second adjacent aperture, with said second aperture being adjacent a third aperture of said larger area and so on, with said bottom surface having a second plurality of alternating apertures each aligned with and underlying one of said apertures on said top surface along a common axis but of opposite configuration whereby said first aperture on said top surface is aligned with a corresponding partial aperture on said bottom surface of said smaller area, with said smaller area aperture on said bottom surface adjacent a larger area partial aperture which is aligned with a smaller area aperture of said top surface and so on, with each of said larger area apertures having facing outer surfaces forming an arc gap for said link, with each set of corresponding apertures on said top and bottom surfaces separated by a central aperture along said common axis, wherein an electrical arc generated during fuse operation is caused to zig zag along said planar member from a top surface larger diameter partial aperture to a bottom surface larger diameter partial aperture to traverse said planar member from said first to said second end terminal of said electrical fuse.

DETAILED DESCRIPTION OF THE FIGURES

Figure 1:
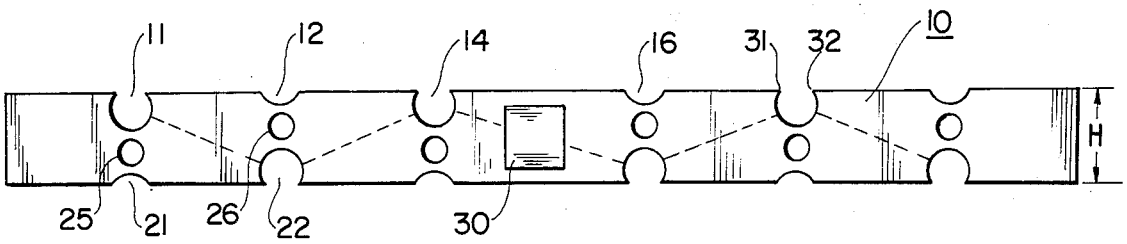
FIG. 1 is a top plan view of an asymmetrical fuse link according to this invention.

Referring to FIG. 1, there is shown a top plan view of fuse link 10 according to the principles of this invention.

As one can see, fuse link 10 is a relatively thin planar structure which is preferably fabricated from a good conducting material such as copper. Essentially, many fuse links are constructed from copper or silver or suitable alloys thereof, both of which materials are widely employed. It is, of course, understood that silver is more expensive than copper. Copper exhibits a slower link material performance than does silver which is inherently capable of faster action. The link 10, as will be explained, is preferably fabricated from copper to thereby reduce the cost of the link but can be fabricated from silver as well as other materials which suits its required operation.

Based on the explanation of operation, one will see that the link configuration of FIG. 1 enables a designer to utilize approximatey ¼ of the mass of copper or silver as required by a prior art link of similar ratings. The link depicted in FIG. 1 is designated as an asymmetrical link due to the following considerations.

As one can see, the top surface of the link contains a plurality of alternating apertures of different areas. Thus there is a first partial aperture 11 which is formed in the top surface of the link. To the right of aperture 11 is a smaller are partial aperture 12, to the right of aperture 12 is another larger area aperture 14, to the right of which is again a smaller area aperture 15. Thus as one can see from FIG. 1, both the top and bottom surfaces are characterized by alternating larger apertures as 11 and smaller apertures as 12.

The top aperture 11 which is a large partial aperture is associated with a small aperture 21 on the bottom surface which aperture 21 is positioned along the same common axis and is approximately the same diameter as aperture 11. To the right of aperture 21 is a larger aperture 22 which is associated with the top smaller aperture 12. Disposed between each of the small and large apertures as 11 and 12 is a center aperture 25. Thus the link is designated as an asymmetrical link due to the fact that larger and smaller apertures are staggered both on the top surface and the bottom surface and each of the larger and smaller apertures as 11 and 21 are positioned above and below a central aperture 25. Positioned in the center of the link between apertures 14 and 15 is a globule of a low melting material 30 such as tin.

The purpose of tin globule 30 is to reduce the melting point of the fuse link as is well known in the art and various other materials as can be employed as well. Before proceeding with an explanation of operation, the typical dimensions of the large and small apertures as 11 and 21 will be given. The apertures as seen are partial circles in configuration. The large apertures as 11 and 14 constitute approximately 75% to 90% of a full circle. The end points which are relatively sharp edges as points 31 and 32 act as an arc gap where a peak arc voltage will jump across the spacing between points 31 and 32 associated with each of the larger apertures.

The smaller apertures as 12 and 21 are between 10% to 25% of the circle. Each of the partial circular apertures have approximately the same radius. As can be seen, the smaller apertures as 12 and 21 do not have sharp points and, therefore, offer greater resistance for arc travel. In this manner, the arc generated when the fuse begins to interrupt current is accommodated by the larger apertures. Essentially, the arc will zig zag along the link, and hence travel from the points such as 31 and 32 of aperture 11 to the corresponding points of aperture 22 back to aperture 14 and so on as indicated by the dashed lines on the drawings. The arc will assume this path of least resistance which the arc points provide.

Assume the fuse link is subjected to an excessive current. The following occurs. The reduced cross section, as for example that portion of the link between apertures 12, 26 and 22, begins to melt forming a plasma. The resultant magnetic field of the plasma about aperture 26 causes the top material to be thrown in the direction of the top of the link and the bottom surrounding material to be thrown in the direction of the bottom of the link. This increases speed of operation to enable the link to more efficiently cut off the current flow. As the current is reduced, the resistance at the above noted link section drastically increases, thus creating a potentially high peak voltage, due to the stored energy in the system as dependent upon the rate of current charge with respect to time and the high resistance of the section. Hence a potentially large voltage would appear across the link. As the voltage starts to rise an arc is generated across the large apertures as 11, 22, and 14, each of which is characterized in having facing pointed edges, forming a calibrated arc gap. This action dissipates the stored energy while causing the current to zig zag along opposite edges of the link to prevent the link material from being excessively heated to its ignition point, as would occur in prior art links. The zig zag effect assures that both edges of the link simultaneously dissipate the stored energy while the attendant heat is distributed in the link in a controlled fashion. Such an ignition would cause a catastrophic failure of the entire fuse assembly.

Thus in the link embodiment shown, the asymmetrical construction provides arc quenching points as apertures 11, 22, and 14. The reduced cross sectional area formed by apertures 12, 26 and 22 gives fast initial reaction and provides high initial resistance which initially reduces current flow. The link reacts to the peak recovery voltages by the calibrated arc gaps to allow the energy to dissipate. The link due to the structure is thin and relatively narrow and thus is about ¼ of the mass of a prior art link of similar ratings.

In a conventional fuse the generation of the arc will cause the foil-like link to burn and melt. In this fuse the arc is forced to zig zag so that the arc does not burn the foil but the actual current will eventually melt the link while the asymmetrical apertures will force the arc to zig zag along the link.

Figure 2:
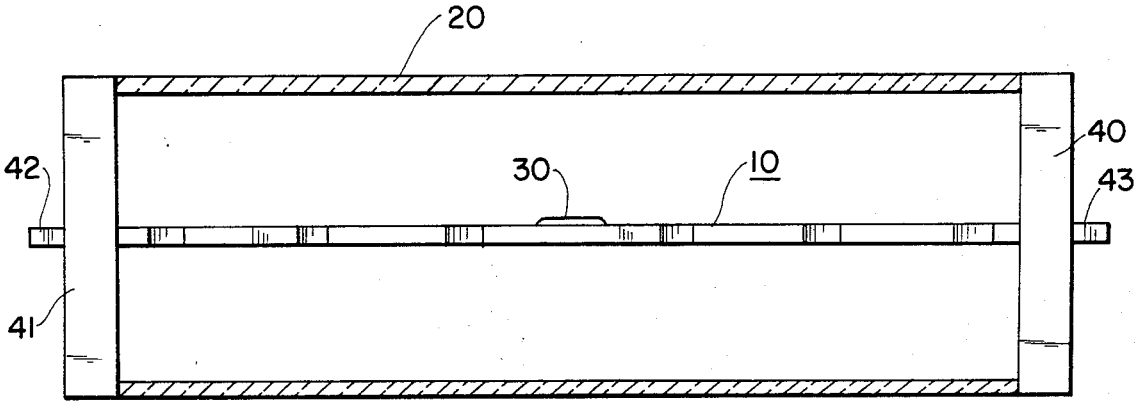
FIG. 2 is a partial sectional view of the link as employed in a fuse cartridge.

Referring to FIG. 2, there is shown a link 10 which is arranged in a conventional fuse arrangement. The link 10 as shown in FIG. 1 may be disposed within an outer casing or cylindrical housing 20 and may be directly connected to either end caps as 40 and 41 which are fabricated from a good conducting material such as copper or may be directly connected to end terminals such as 42 and 43 to produce various fuse configurations which are known in the art. The hollow of the housing may conventionally contain a granular filler, as quartz or sand, to assist in arc quenching as is known in the art. Hence there is disclosed an asymmetrical link for a fuse which link because of the diameters of the respective apertures on the top and bottom surfaces cause an arc to zig zag along the link creating a fuse with a fast reaction time. Due to the fact that the amount of material used in the link is greatly reduced, the fuse melts rapidly while effectively suppressing generated peak recovery voltage. In a typical fuse link, the center apertures 25 were constructed of a diameter of 0.038 inch with the large apertures as 11 being circular and of a radius of 0.03 inch and as indicated constituting between 75% to 90% of a circle. The smaller partial apertures as 12 and 21 have a radius of 0.03 inch and as indicated constituted between 10%–25% of a circle.

The spacing between the center points of a large and a small aperture as between 11 and 12 was approximately 0.30 inch with the effective height of the link H being 0.112 inch. These dimensions are by way of example and have been employed in implementing a fuse capable of interrupting a current of 30 amps. Because of the asymmetrical nature of the link, aproximately ¼ of material mass is used as compared to material used in a prior art configuration. The links can be in multiples and used in fuses capable of carrying up to 4,000 amps or greater. These fuses will exhibit superior short circuit current interrupting capability of 200,000 amps or better.

It should be apparent to those skilled in the art that there are many alternative embodiments which one can perceive, all of which are deemed to be encompassed within the scope and breadth of the claims appended hereto.

What is claimed is

1. An asymmetrical fuse link apparatus for deployment between first and second end terminals of an electrical fuse, comprising:

a planar member having top and bottom relatively parallel surfaces, with said top surface containing a first plurality of alternating partial apertures with a first aperture being of a larger area than a second adjacent aperture, with said second aperture being adjacent a third aperture of said larger area and so on, with said bottom surface having a second plurality of alternating apertures each aligned with and underlying one of said apertures on said top surface along a common axis but of opposite configuration whereby said first aperture on said top surface is aligned with a corresponding partial aperture on said bottom surface of said smaller area, with said smaller area aperture on said bottom surface adjacent a larger area partial aperture on said bottom surface which is aligned with a smaller area aperture on said top surface and so on, with each of said larger area apertures having sharp edged facing outer surfaces forming arc gaps for said link, with said smaller area apertures having smooth facing outer surfaces providing a high resistance arc path with each set of corresponding apertures on said top and bottom surfaces separated by a central aperture along said common axis, wherein an electrical arc generated during fuse operation is caused to zig zag along said planar member from a top surface larger area partial aperture to a bottom surface larger area partial aperture to traverse said planar member from said first to said second end terminal of said electrical fuse.

2. The fuse link according to claim 1, wherein each of said larger area partial apertures is of a partial circular configuration of a given diameter being between 75% to 90% of a circle with said facing sharp edged outer surfaces being the respective edges of said circular configuration.

3. The fuse link apparatus according to claim 2, wherein said small area partial apertures are each of a partial circular configuration of said given diameter being between 10% to 25% of a circle.

4. The fuse link apparatus according to claim 2, wherein said planar member is fabricated from copper.

5. The fuse link apparatus according to claim 1, wherein said planar member is fabricated from silver.

6. The fuse link member according to claim 3, wherein said central aperture is a circular aperture of a smaller diameter than said given diameter.

7. The fuse link according to claim 1, further including a low melting point material secured to said planar member relatively at the center and located on the surface thereof between respective sets of partial apertures.

8. The fuse link apparatus according to claim 7, wherein said low melting point material is tin.

9. The fuse link apparatus according to claim 1, wherein said partial larger area aperture is at least five times larger in area than said smaller partial aperture.

10. The fuse link apparatus according to claim 1, wherein said planar member is included within the hollow confines of a tubular fuse housing.

11. The fuse link apparatus according to claim 10, wherein said housing has first and second conductive end caps defining first and second terminals with said planar member connected therebetween.

12. The fuse link apparatus according to claim 10, wherein said housing has first and second end terminals with said planar member connected therebetween.

* * * * *